US005450737A

United States Patent [19]

Sasaki

[11] Patent Number: 5,450,737

[45] Date of Patent: Sep. 19, 1995

[54] REMOVABLE LOCK HANDLE ASSEMBLY

[75] Inventor: Shunji Sasaki, Tokyo, Japan

[73] Assignee: Takigen Manufacturing Co., Ltd., Tokyo, Japan

[21] Appl. No.: 95,673

[22] Filed: Jul. 21, 1993

[30] Foreign Application Priority Data

Mar. 4, 1993 [JP] Japan ..... 5-069251

[51] Int. Cl.[6] ..... E05B 15/06

[52] U.S. Cl. ..... 70/346; 70/224; 70/379 R; 292/336.3

[58] Field of Search ..... 70/207, 209, 224, 346, 70/77–79, 367, 368, 379 R, 380, 401–404, 423, 424, 427, 428, 455, 454, 444, 445, DIG. 31; 292/336.3

[56] References Cited

U.S. PATENT DOCUMENTS

| | | | |
|---|---|---|---|
| 531,656 | 1/1895 | Spencer et al. | 70/444 X |
| 1,639,535 | 8/1927 | Russo | 70/379 R |
| 1,853,918 | 4/1932 | Miller | 70/DIG. 31 X |
| 2,036,764 | 4/1936 | Lowe | 70/379 R |
| 3,519,979 | 7/1970 | Bodenstein | 70/404 X |
| 4,022,039 | 5/1977 | Mikos | 70/491 X |
| 4,083,211 | 4/1978 | Scherbing | 70/491 |
| 4,296,618 | 10/1981 | Guiraud | 70/401 X |
| 4,391,111 | 7/1983 | Marcy | 70/346 X |
| 4,446,709 | 5/1984 | Steinbach | 70/424 X |
| 4,556,244 | 12/1985 | Bisbing | 292/336.3 X |
| 4,565,080 | 1/1986 | Kincaid et al. | 70/224 X |
| 4,598,563 | 7/1986 | Berkowitz | 70/452 X |
| 4,638,652 | 1/1987 | Morse et al. | 70/454 |
| 4,686,843 | 8/1987 | Martikainen et al. | 70/453 X |
| 4,759,204 | 7/1988 | Neyret | 70/367 X |
| 4,907,716 | 3/1990 | Wankel et al. | 70/346 X |
| 5,010,745 | 5/1991 | Hall et al. | 70/379 R X |
| 5,024,073 | 6/1991 | Lloyd | 70/491 |
| 5,044,183 | 9/1991 | Neyret | 70/379 R X |
| 5,237,843 | 8/1993 | Charbonneau et al. | 70/346 |

FOREIGN PATENT DOCUMENTS

| | | | |
|---|---|---|---|
| 800683 | 7/1936 | France | 70/346 |
| 680416 | 8/1939 | Germany | 70/401 |
| 148763 | 9/1988 | Japan . | |
| 153703 | 9/1988 | Japan . | |

*Primary Examiner*—Peter M. Cuomo
*Assistant Examiner*—Suzanne L. Dino
*Attorney, Agent, or Firm*—Martin Smolowitz

[57] ABSTRACT

A removable lock handle assembly comprises a door side casing, a disk-like drive member, an eccentric drive projection provided on the rear surface of the drive member, a driven projection provided on the front surface of the drive member, a removable lock handle having a driven projection to be engaged with the driven projection of the drive member for rotation thereof when the handle is inserted into the casing through a front handle insertion hole thereof, a coil spring fitted in an annular groove formed in a central part of the front surface of the drive member, a latch provided in the casing such as to be projected and retreated from and into the casing through a side hole formed therein, a shutter provided on the back side of the handle insertion hole for closing the hole, the drive member being inserted in the casing, the latch having a driven projection for engagement with the drive projection of the drive member, a return compression coil spring received in a blind hole formed in the latch on the side thereof opposite an inclined cam surface and on the side of the driven projection, a return compression coil spring provided between the latch and the inner surface of the casing, and a rear lid fitted in and secured by a screw to a rear portion of the casing, the latch being retreated into the casing when the drive member is turned by the removable lock handle.

1 Claim, 3 Drawing Sheets

REMOVABLE LOCK HANDLE ASSEMBLY

BACKGROUND OF THE INVENTION

1. Field of the Invention

This invention relates to a removable lock handle assembly used for doors of distributor boxes, lockers, etc.

2. Prior Art

Japanese Utility Model Laid-Open Publication No. S63-148763 discloses a lock handle assembly. In this lock handle assembly, a latch operation handle is mounted on a stationary body such that it can not be removed therefrom. Therefore, the handle projects from the front door surface. This means that the handle is obstructive to traffic and liable to cause injury to passers-by.

Accordingly, a removable lock handle assembly has been proposed, in which a latch operation handle is removed from the stationary frame after the door is closed, as disclosed in Japanese Utility Model Laid-Open Publication No. S63-153703. In this structure, however, a lock member provided on the rear side of a door is rotated by 90 degrees for engagement and disengagement with and from an engagement member on the stationary frame side. That is, this removable lock handle assembly does not have a structure that a latch member is caused to undergo linear motion for engagement and disengagement with respect to a stationary frame side engagement member. In the assembly system where the lock member is rotated on the back side of the door, it is necessary to provide a space on the back side of the door to permit rotation of the lock member. This imposes restriction on the scope of application of the removable lock handle assembly.

SUMMARY OF THE INVENTION

An object of the invention is to provide a removable lock handle assembly, which uses a latch driven to undergo linear motion, thus permitting the locking and unlocking and also the opening and closing of a door to be done simply and reliably, as well as requiring no large lock member operation space on the back side of the door, thus providing for increased scope of applications.

To attain the above object of the invention, there is provided a removable lock handle assembly, which comprises a door side casing, a disk-like drive member, an eccentric drive projection on a rear surface of the drive member, a driven projection provided on a front surface of the drive member, a removable lock handle having a drive projection to be engaged with the driven projection of the drive member for rotation thereof when the handle is inserted into the casing through a front handle insertion hole thereof, a coil spring fitted in an annular groove formed in a central part of the front surface of the drive member, a latch provided in the casing such as to be projected and retreated from and into the casing through a side hole formed therein, a shutter provided on a back side of the handle insertion hole for closing the hole, the drive member being inserted in the casing, the latch having a driven projection for engagement with the drive projection of the drive member, a return compression coil spring received in a blind hole formed in the latch on the side thereof opposite an inclined cam surface and on the side of the driven projection, a return compression coil spring provided between the latch and the inner surface of the casing, and a rear lid fitted in and secured by a screw to a rear portion of the casing, the latch being retreated into the casing when the drive member is turned by the removable lock handle.

The above and other objects, features and advantages of the invention will become more apparent from the following description when the same is read with reference to the accompanying drawings.

DETAILED DESCRIPTION OF THE PREFERRED EMBODIMENT

Figure 1:
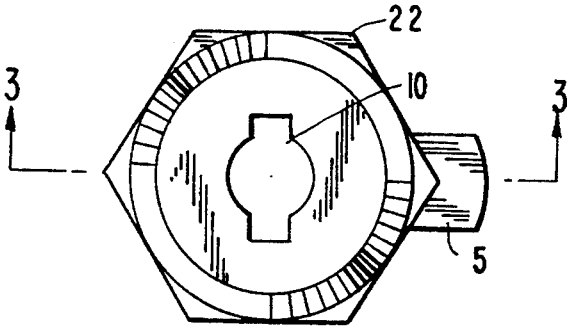
FIG. 1 is a front view showing an embodiment of the removable lock handle assembly according to the invention.
Figure 3:
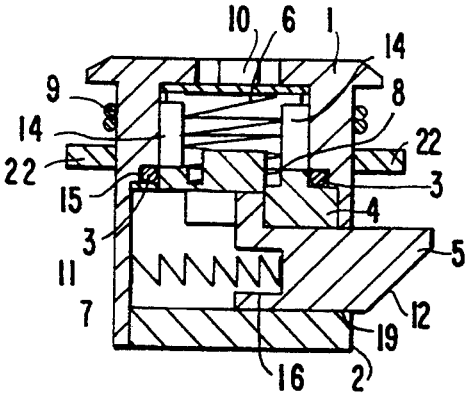
FIG. 3 is a sectional view taken along line 3—3 in FIG. 1.
Figure 2:
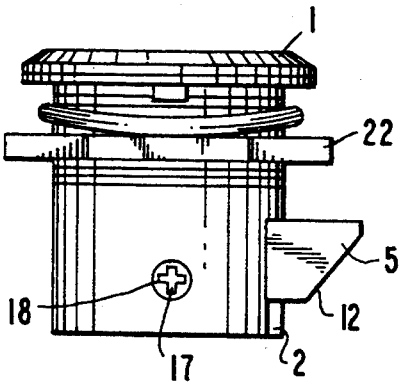
FIG. 2 is a bottom view showing the same lock handle assembly.
Figure 4:
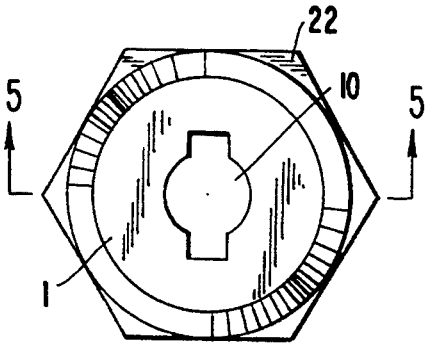
FIG. 4 is a front view showing a stationary body used in the same lock handle assembly.
Figure 5:
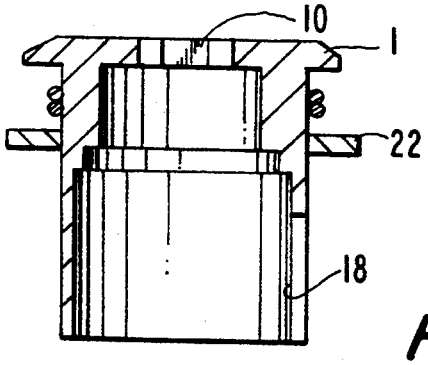
FIG. 5 is a sectional view taken along line 5—5 in FIG. 4.
Figure 6:
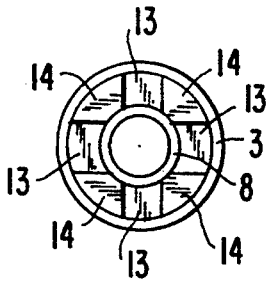
FIG. 6 is a front view showing a drive disk used in the same lock handle assembly.
Figure 7:
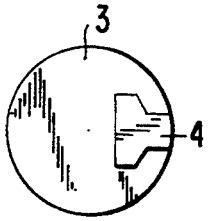
FIG. 7 is a back view showing the same drive disk.
Figure 8:
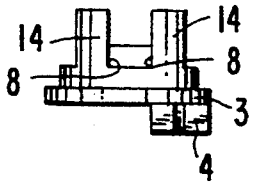
FIG. 8 is a bottom view showing the same drive disk.
Figure 9:
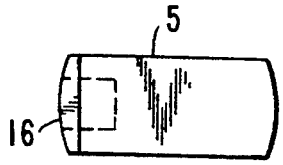
FIG. 9 is a front view showing a latch rod used in the same lock handle assembly.
Figure 10:
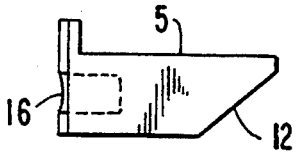
FIG. 10 is a bottom view showing the same latch rod.
Figure 11:
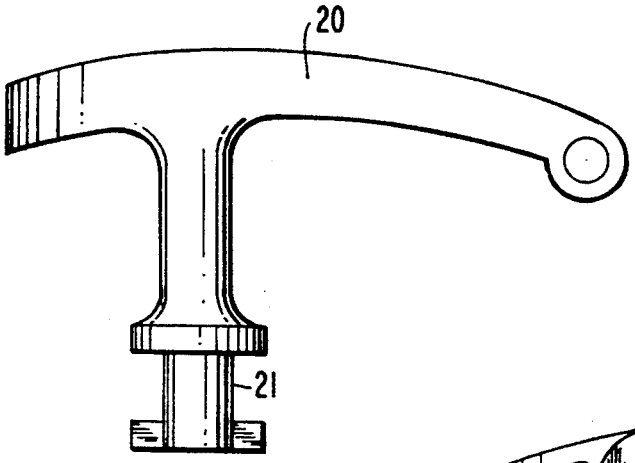
FIG. 11 is a bottom view showing a handle for turning operation used in the same lock handle assembly.
Figure 12:
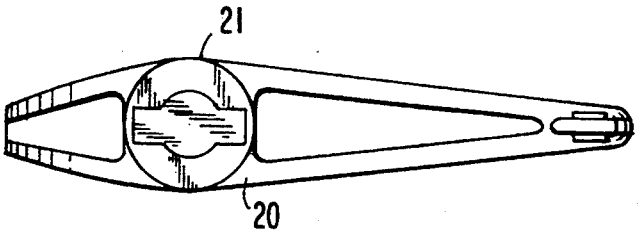
FIG. 12 is a back view showing the same handle for turning operation.

Now, a preferred embodiment of the removable lock handle assembly according to the invention will be described with reference to the drawings. Referring to the Figures, a door side lock handle assembly casing 1 accommodates a disk-like drive member 3. The drive member 3 has an eccentric drive projection 4 projecting from its rear surface. The drive member 3 also has a driven projection 14 projecting from its front surface. The driven projection 14 is engaged by an operating projection 21 of a removable lock handle 20 when the handle 20 is inserted into a handle insertion hole 10 provided at the front of the casing 1. The front surface of the drive member 3 is formed with a central annular groove 8, in which an end of a compression coil spring 6 is received.

The peripheral wall of the casing 1 has a hole 19, through which a latch 5 is projected from and retreated into the casing. The handle insertion hole 10 is closed by a cross-shaped shutter 9 disposed on its rear side. The drive member 3 is inserted in the casing 1 with an O-ring 15 fitted on its outer periphery.

The latch 5 has a driven projection 11 projecting from its front surface and engaging with the drive projection 4 of the drive member 3. The latch 5 also has an inclined cam surface 12 formed on its side opposite the driven projection 11. A side surface of the latch 5 on the side of the driven projection 11, i.e., on the side of the latch 5 opposite the cam surface 12, is formed with a blind hole 16, in which an end of a return compression coil spring 7 is received. The latch 5 is inserted with the return compression coil spring 7 in the casing 1, and a lid 2 is fitted in a rear portion of the casing 1 and secured to the case by a screw 17.

In this removable lock handle assembly, in a state thereof without insertion of the removable lock handle 20, the shutter 9 is held in close contact with the inner surface of a front end inner flange of the casing 1 defining the handle insertion hole 10 by the compression coil spring 6. In this state, the hole 10 is held closed. Further, the drive projection 4 of the drive member 3 is in engagement with the driven projection 11 of the latch 5, and the latch 5 is held biased by the return compression coil spring 7 to be held at its projected position.

When the removable lock handle 20 is inserted into the casing 1 through the hole 10, the shutter 9 and an operating projection 21 of the handle 20 are received in a cross-shaped recess 13 in the drive member 3, and the driven projection 14 and the operating handles projection 21 are engaged with each other. In this state, by turning the handle 20, the drive member 3 is turned. With the turning of the drive member 3, the drive projection 4 thereof drives the driven projection 11, thus causing the latch 5 to be retreated into the casing 1 against the biasing force of the compression coil spring 7. As a result, the free end of the latch 5 is separated from a stationary frame side engagement member (not shown).

In the illustrated embodiment, the casing 1 is fitted in a mounting hole (not shown) formed in a door from the front side thereof, and then it is secured to the door by fitting a nut on it from the back side of the door. The stationary frame of a distributor box or the like (not shown) is provided with an engagement member which engages with the latch 5. The front side of the drive member 3 is provided with driven projections 14 at four corners. The cross-shaped recess 13 is formed between these-driven projections 14.

In the center of the cross-shaped recess 13 the annular groove 8 is provided, and the compression coil spring 6 is fitted in the annular groove 8. The shutter 9 is urged against the front end inner flange defining the insertion hole 10 by the compression coil spring 6, and the hole 10 is thus held closed. The return compression coil spring 7 has one end received in the blind hole 16 of the latch 5, and has the other end engaged with the inner wall surface of the casing 1. Thus, the coil spring 7 is urging the latch 5 to be at a projecting position. In this state, the latch 5 is in engagement with the stationary frame side engagement member, (not shown) thus holding the door locked in the closed position thereof.

The drive projection 4 is provided eccentrically on the rear surface of the drive member 3. Thus, by inserting the removable lock handle 20 into the casing 1 from the insertion hole 10 and turning the handle with the drive projection 21 thereof in engagement with the driven projection 14, the drive member 3 is rotated. The drive projection 4 thus pushes the driven projection 11 of latch 5 in the retreating direction, thus causing the latch 5 to be retreated against the force of the return compression coil spring 7. As a result, the latch 5 is disengaged from the engagement member to unlock the door. In this state, the door can be opened by pulling the removable lock handle 20.

As has been shown, with the removable lock handle assembly according to the invention only being used when opening and closing the door the removable lock handle 20 is inserted into the casing, and normally it is stored in a separate place. Thus, normally there is no projection to the front side of the door, and thus the adjacent passage can be used widely by that much to reduce the possibility of injury to passers-by.

Further, the removable lock handle assembly according to the invention functions with linear driving of the latch 5 by the drive member 3 interlocked to the removable lock handle 20. Thus, it permits simple and reliable operations of locking and unlocking the door with a simplified structure. Besides, there is no need of providing large locking/unlocking operation space on the back side of the door, and thus the assembly can find an increased scope of applications.

What is claimed is:

1. A removable lock handle assembly, comprising:

a door side casing adapted for mounting in a door, a disk-like drive member (3) having an eccentric drive projection (4) provided on a rear surface of said drive member and a driven projection (14) provided on a front surface of said drive member (3), a removable lock handle (20) having a drive projection (21) to be engaged with said driven projection (14) of said drive member (3) for rotation thereof when said handle is inserted into said casing through a front handle insertion hole (10) thereof, a coil spring (6) fitted in an annular groove (8) formed in a central part of the front surface of said drive member, said drive member (3) having a cross-shaped recess (13) formed in the front surface, a latch (5) provided in said casing such as to be projected from and retreated into said casing through a side hole formed therein, a cross-shaped shutter (9) provided on a back side of said handle insertion hole (10) for closing the hole, said drive member (3) being inserted with an O-ring (15) fitted thereon in said casing, said latch (5) having a driven projection (11) formed on a front surface for engagement with said drive projection (4) of said drive member (3), said latch (5) having an inclined cam surface (12) formed on its side opposite from said driven projection (11), a return compression coil spring (7) received in a blind hole formed in said latch (5) on the side thereof opposite said inclined cam surface (12) and on the side of said driven projection (11), said latch (5) being inserted with said return compression coil spring (7) in said casing (1); and a rear lid (2) fitted in and secured by a screw (17) to a rear portion of said casing, said latch (5) being retreated into said casing (1) when said drive member (3) is turned by said removable lock handle (20).

* * * * *